US008777730B2

(12) United States Patent
Koyama

(10) Patent No.: US 8,777,730 B2
(45) Date of Patent: Jul. 15, 2014

(54) GAME BETTING DEVICE

(75) Inventor: Toshimi Koyama, Koto-ku (JP)

(73) Assignee: Universal Entertainment Corporation, Tokyo (JP)

( * ) Notice: Subject to any disclaimer, the term of this patent is extended or adjusted under 35 U.S.C. 154(b) by 265 days.

(21) Appl. No.: 12/820,313

(22) Filed: Jun. 22, 2010

(65) Prior Publication Data

US 2011/0014973 A1 Jan. 20, 2011

(30) Foreign Application Priority Data

Jul. 16, 2009 (JP) ..... 2009-167593

(51) Int. Cl.
*A63F 9/00* (2006.01)
*G07F 17/32* (2006.01)

(52) U.S. Cl.
CPC ..... *G07F 17/322* (2013.01); *G07F 17/32* (2013.01); *G07F 17/3232* (2013.01)
USPC ..... 463/25

(58) Field of Classification Search
None
See application file for complete search history.

(56) References Cited

U.S. PATENT DOCUMENTS 5,651,548 A * 7/1997 French et al. ..... 463/25
7,460,079 B2 * 12/2008 Koyama et al. ..... 343/788
7,982,617 B2 * 7/2011 Koyama et al. ..... 340/572.7
8,052,513 B2 * 11/2011 Koyama ..... 463/16
2007/0035399 A1 * 2/2007 Hecht et al. ..... 340/572.1
2007/0293303 A1 * 12/2007 Shayesteh ..... 463/25
2009/0075725 A1 * 3/2009 Koyama ..... 463/25
2009/0085752 A1 * 4/2009 Koyama et al. ..... 340/572.7
2009/0117967 A1 * 5/2009 Koyama ..... 463/17
2009/0233698 A1 * 9/2009 Koyama ..... 463/25
2009/0291751 A1 * 11/2009 Koyama ..... 463/25

FOREIGN PATENT DOCUMENTS

| | | |
|---|---|---|
| CN | 1163579 | 10/1997 |
| JP | 2004-102953 | 4/2004 |
| JP | 2004-105321 | 4/2004 |
| JP | 2009-112490 | 5/2009 |
| WO | 96/03188 | 2/1996 |

OTHER PUBLICATIONS

Japanese Patent Office, Office Action dated Aug. 27, 2013 of the corresponding Japanese application (Japanese Patent Application No. 2009-167593).
Patent Office of the People's Republic of China, Chinese Office Action of CN Application No. 201010210544.2 dated Nov. 19, 2012.

* cited by examiner

*Primary Examiner* — Seng H Lim
(74) *Attorney, Agent, or Firm* — Lexyoume IP Meister, PLLC

(57) ABSTRACT

The present application provides a game betting device, wherein each of antennas 21 belongs both two major groups, the major groups are further classified into a plurality of small groups, two major groups have different classifications of the small groups from each other, and at least one column or at least one row in the alignment of the betting regions includes a plurality of small groups included in an identical major group in a single column or row. The game betting device according to the present application makes it possible to read out a chip on a betting board in a short time.

10 Claims, 14 Drawing Sheets

FIG. 12

| Readout unit in each example | |
|---|---|
| Number of betting region | 27 |
| Readout unit<br>in the case of Example 1<br>In the case of 9 × 3 matrix | 12 |
| Readout unit<br>in the case of Example 2<br>In the case of 3 × 3 × 3 matrix | 9 |

FIG. 13

| | | Standard | Example 1 | Example 2 |
|---|---|---|---|---|
| Number of betting region | | 27 | 27 | 27 |
| Number of dimension | | 1 | 2 | 3 |
| | | | | |
| Readout unit | | 27 | 12 | 9 |
| (Number of readout) | | | | |
| Switching time (sec) | | 13.5 | 6 | 4.5 |
| | | | | |
| Readout time (sec) when the number | | | | |
| of game chips is as follows | 1 | 0.05 | 0.1 | 0.15 |
| | 10 | 0.5 | 1 | 1.5 |
| | 20 | 1 | 2 | 3 |
| | 50 | 2.5 | 5 | 7.5 |
| | 75 | 3.75 | 7.5 | 11.25 |
| | 100 | 5 | 10 | 15 |
| | | | | |
| Total amount of time of antenna | | | | |
| switching and readout time | 1 | 13.55 | 6.1 | 4.65 |
| (sec) | 10 | 14 | 7 | 6 |
| | 20 | 14.5 | 8 | 7.5 |
| | 50 | 16 | 11 | 12 |
| | 75 | 17.25 | 13.5 | 15.75 |
| | 100 | 18.5 | 16 | 19.5 |

GAME BETTING DEVICE

CROSS-REFERENCE TO RELATED APPLICATIONS

This application is based upon and claims a priority from the prior Japanese patent Application 2009-167593 filed on Jul. 16, 2009, the entire contents of which are incorporated herein by reference.

BACKGROUND OF THE INVENTION

1. Field of the Invention

The present invention relates to a game betting device.

2. Description of the Related Art

Conventional, game betting devices are disclosed in Japanese Unexamined Patent Application Publication No. 2004-105321 and Japanese Unexamined Patent Application Publication No. 2004-102953, for example. In these game betting devices, when an X-side transmitting antenna and a Y-side transmitting antenna transmit a radio wave, a radio wave is generated by a flux perpendicular to a table at a cross point of X and Y to read out an ID of a wireless IC tag provided in a chip put on a table on the cross point and the readout is implemented for each of the betting regions successively.

There is, however, a problem in the techniques disclosed in the Patent Documents 1 and 2. More specifically, a chip on the table is read successively for each betting region, so that the readouts have had to be implemented the same number of times as the numbers of betting regions in order to read all the chips on the table. Therefore, it has taken a long time to read all the chips on the table.

Then, it is conceivable that in the alignment of the betting regions on the table, an antenna for reading out the chips is provided corresponding to each column and row. More specifically, the antennas are provided for simultaneously reading out all the betting regions included in the first column, for simultaneously reading out all the betting regions included in the second column, . . . , and for simultaneously reading out all the betting regions included in the last column. Likewise, the antennas are provided for simultaneously reading out all the betting regions included in the first row, for simultaneously reading out all the betting regions included in the second row, . . . , and for simultaneously reading out all the betting regions included in the last row. Then, the implementation of the logical AND operation between the readout result of the antenna in a certain column and the readout result of the antenna in a certain row makes it possible to determine the chip on the betting region positioned in the intersecting region of the antennas in the column and row.

Even though such antennas are provided in the column and row, however, the reading out must be implemented the same number of times as the total number of the antennas in the columns and rows. Thus, there is a problem that it requires a long time to read all the chips on the table.

The object of the present invention is to implement the reading out of the chip on the betting board in a short time.

SUMMARY OF THE INVENTION

In a first aspect of the present invention, a game betting device includes a betting board provided with a plurality of betting regions, a group of antennas having a plurality of antennas corresponding to each of the plurality of betting regions, each of the plurality of antennas belonging to any of a predefined plurality of major groups, all of the major groups being further classified into a plurality of small groups, each of the major groups having the classification of the plurality of small groups different from each other, at least one column or at least one row in the alignment of the plurality of betting regions including the antennas belonging to the small groups different from each other in the identical major group, a detection device which simultaneously drives the plurality of antennas belonging to the identical small groups for each the small group successively to detect a game chip on the betting board, and a determination device which implements the logical AND operation between the major groups regarding the detected result of the chip to determine the betting region having the chip put thereon.

In a second aspect of the present invention, a game betting device includes a plurality of antennas capable of communicating with the game chip, each antenna being provided corresponding to each of a plurality of betting regions, the plurality of antennas being divided into a plurality of first groups and a plurality of second groups, all of the antennas being assigned to the plurality of first groups, each of the plurality of antennas belonging to any one of the plurality of first groups all of the antennas being assigned to the plurality of second groups, each of the plurality of antennas belonging to any one of the plurality of second groups, the antennas belonging to the plurality of first groups being assigned to the plurality of second groups so that each of the antennas belonging to each of the first groups belongs to the plurality of second groups different from each other; a control device which successively sends selection signals for selecting each of the plurality of first groups and each of the plurality of second groups; an antenna selecting device which successively selects each of the plurality of first groups in response to the selection signal to transmit to the control device a first output signal sent from the antenna belonging to the selected first groups, and which successively selects each of the plurality of second groups in response to the selection signal to transmit to said control device a second output signal sent from the antenna belonging to the selected second groups; and a chip determination device which determines the betting region having the game chip put thereon out of the plurality of betting regions from the result of the logical AND operation between the first chip readout result indicated by the first output signal and the second chip readout result indicated by the second output signal.

BRIEF DESCRIPTION OF THE DRAWINGS

FIG. 12 is an explanatory diagram showing a specific example according to an embodiment of the present invention.

FIG. 13 is an explanatory diagram showing a specific example according to an embodiment of the present invention.

DESCRIPTION OF THE PREFERRED EMBODIMENTS

Figure 1:
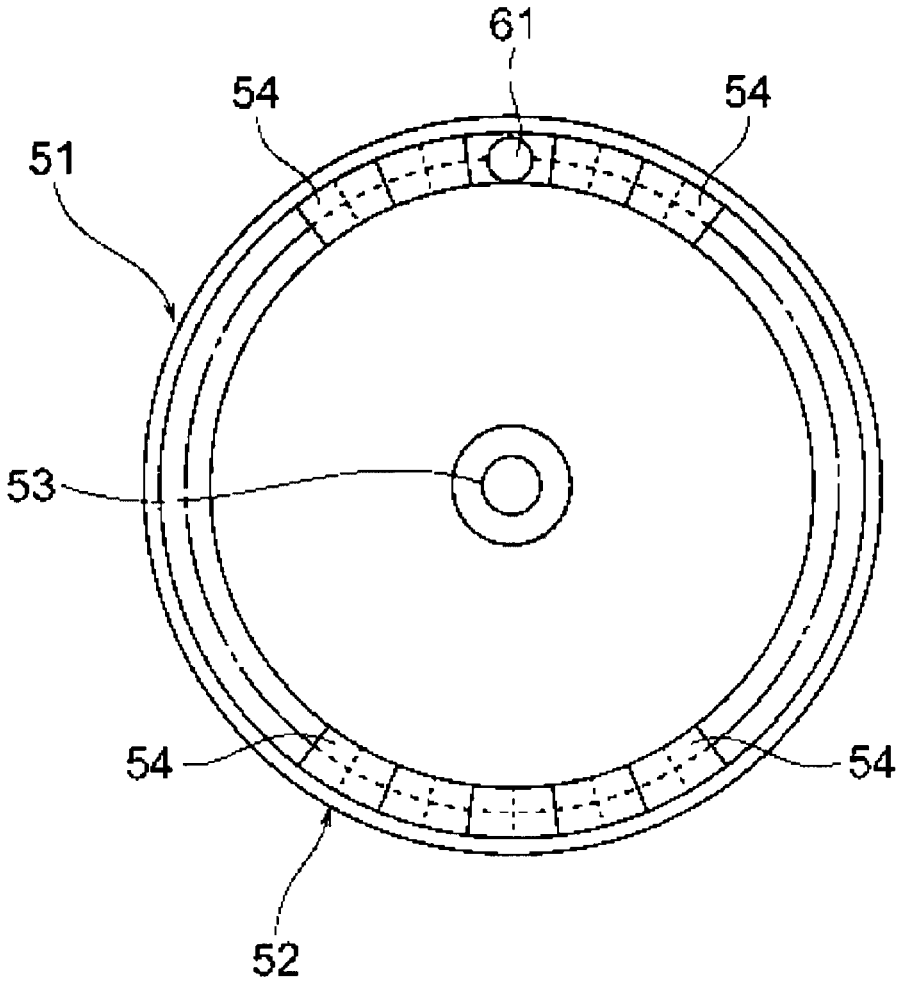
FIG. 1 is a plan view showing a roulette wheel according to an embodiment of the present invention.

In a first aspect of the present invention, a game betting device includes a betting board provided with a plurality of betting regions, a group of antennas having a plurality of antennas corresponding to each of the plurality of betting regions, each of the plurality of antennas belonging to any of a predefined plurality of major groups, all of the major groups being further classified into a plurality of small groups, each of the major groups having the classification of the plurality of small groups different from each other, at least one column or at least one row in the alignment of the plurality of betting regions including the antennas belonging to the small groups different from each other in the identical major group, a detection device which simultaneously drives the plurality of antennas belonging to the identical small groups for each of the small groups successively to detect a game chip on the betting board, and a determination device which implements the logical AND operation between the major groups regarding the detected result of the chip to determine the betting region having the chip put thereon.

According to the present invention, it is possible to implement the reading out of the chip on the betting board in a short time.

In a second aspect of the present invention, a game betting device includes a plurality of antennas capable of communicating with the game chip, each antenna being provided corresponding to each of a plurality of betting regions, the plurality of antennas being divided into a plurality of first groups and a plurality of second groups, all of the antennas being assigned to the plurality of first groups, each of the plurality of antennas belonging to any one of the plurality of first groups, all of the antennas being assigned to the plurality of second groups, each of the plurality of antennas belonging to any one of the plurality of second groups, the antennas belonging to the plurality of first groups being assigned to the plurality of second groups so that each of the antennas belonging to each of the first groups belongs to the plurality of second groups different from each other; a control device which successively sends selection signals for selecting each of the plurality of first groups and each of the plurality of second groups; an antenna selecting device which successively selects each of the plurality of first groups in response to the selection signal to transmit to the control device a first output signal sent from the antenna belonging to the selected first groups, as well as which successively selects each of the plurality of second groups in response to the selection signal to transmit to said control device a second output signal sent from the antenna belonging to the selected second groups; and a chip determination device which determines the betting region having the game chip put thereon out of the plurality of betting regions from the result of the logical AND operation between the first chip readout result indicated by the first output signal and the second chip readout result indicated by the second output signal.

For example, in the examples shown in FIGS. 5 and 6 set forth below, a plurality of first groups or a plurality of second groups corresponds to a small group (A) to (F) and a small group (i) to (iv). In the example shown in FIG. 11, a plurality of first groups or a plurality of second groups corresponds to a small group (A) to (C), small groups (i) to (iii), and small groups ($\alpha$) to ($\gamma$). Each of a plurality of antennas corresponds to an antenna 21, and each of a plurality of betting regions corresponds to a betting region 3. A control device corresponds to a control part 24, an antenna selecting device corresponds to a relay 31, and a chip identification device corresponds to a control device 14.

In the examples shown in FIGS. 4, 7, 8 and 9, a selection signal corresponds to a relay control signal. A first output signal and a second output signal correspond to a load-modulated radio wave signal to be demodulated at the transmitting/receiving part 22.

A plurality of antennas are divided into a plurality of first groups and a plurality of second groups, and output signals (a first output signal and a second output signal) are transmitted for each group. Therefore, the groups (the first group and the second group) are selected the same number of times as the total sum of the number of a plurality of first groups and the number of a plurality of second groups, and thus it is possible to determine from the output signal whether or not there is a game chip. In this manner, grouping a plurality of antennas can reduce the number of times of selection of the antennas, thereby determining in a short time whether or not there is any game chip. In contrast, if the output signal is transmitted for each of a plurality of antennas, the output signal cannot be received unless the selection is made the same number of times as the number of a plurality of antennas.

It is that also preferable that, when one group is selected by said selection signal from among the first groups, signals simultaneously sent from the antennas belonging to the selected first groups are transmitted as said first output signal to said control device and that, when one group is selected by said selection signal from among the second groups, signals simultaneously sent from the antennas belonging to the selected second groups are transmitted as said second output signal to said control device.

The transmission of the simultaneously output signals to the control device makes it possible to group a plurality of antennas so as to reduce the time required for selection, thereby determining in a short time whether or not there is any game chip.

Furthermore, it is preferable that the first chip readout result and the second chip readout result are identification numbers for identifying the game chips.

Since the game chips are determined by the identification numbers, it is possible to determine without false recognition whether or not there is any game chip.

Still furthermore, each of a plurality of antennas preferably has an approximately the same size. A plurality of antennas having the same size with one another may be arranged corresponding to the shape and size of a plurality of betting regions. Since it is not necessary to tailor the antennas to the shape and size of a plurality of betting regions, general versatility can be improved.

An embodiment according to the present invention will be described below.

Figure 2:
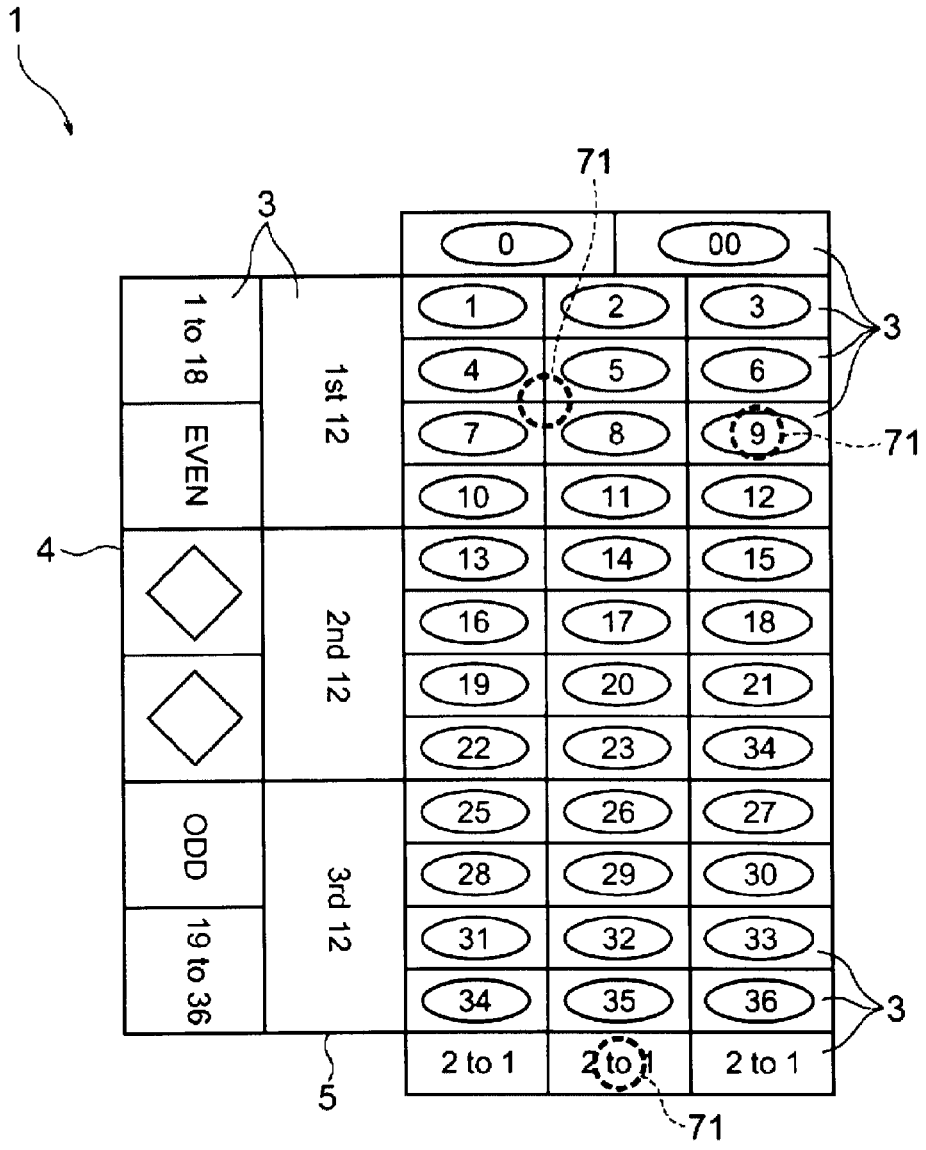
FIG. 2 is a plan view showing a betting board of a game betting device according to an embodiment of the present invention.
Figure 3:
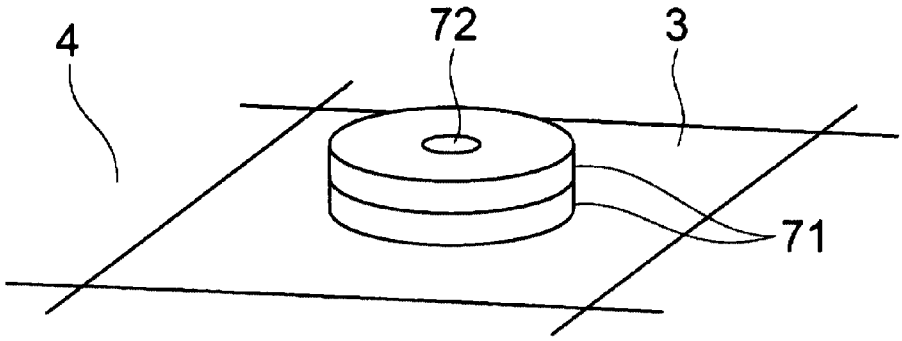
FIG. 3 is a partially enlarged perspective view showing a betting board according to an embodiment of the present invention.

FIG. 1 is a plan view showing a roulette wheel. FIG. 2 is a plan view showing a betting board of a game betting device. FIG. 3 is a partially enlarged perspective view showing the betting board.

A roulette wheel 51 and a game betting device 1 are used, for example, at a casino in a casino-hotel. More specifically, a player plays the game in such a way that he/she makes a prediction on what number a roulette ball 61 thrown in the roulette wheel 51 lands, and uses the game betting device 1 to bet a game chip 71 on a betting region 3 corresponding to the position of the number landed.

The game betting device 1 is provided with a betting board 4 for betting the game chip 71. The betting board 4 has a plurality of betting regions 3 on the top surface thereof, which are each assigned corresponding to the positions of the numbers landed on the roulette wheel 51. Each of a plurality of betting regions 3 is a spot segmented with the numbers such as 0, 00, 1, 2, . . . , 3, 5, and 36. Each of a plurality of betting regions 3 on the betting board 4 is the region partitioned by a frame 5 on the top surface of the betting board 4. Each game chip 71 is provided with a wireless IC tag 72 which stores information about the game chip 71. The roulette wheel 51 is provided with a landed number detection device 52 for detecting the position and type of the number landed by the roulette ball 61 on the roulette wheel 51. The betting board 4 is also provided with a bet information detection device 11 (described below). When the player bet the game chip 71 on the betting region 3, the bet information detection device 11 reads out the information about the game chip 71 stored in the wireless IC tag 72. The bet information detection device 11 detects the bet position of the game chip 71 and the value of the bet money from the information about the game chip 71. Furthermore, a casino is provided with a dividend calculation system (described below; not shown) that calculates the dividend of the game (a roulette game) based on the position of the roulette ball 61 on the roulette wheel 51 and the bet position and value of the game chip 71.

The information about the game chip 71 stored in the wireless IC tag 72 contains a unique number for determining the game chip 71 (a number for identifying the game chip 71), value (such as $1, $5, $10) and color of the game chip 71, a place where the game chip 71 can be used (the information for identifying the casino where the game chip 71 is used), and the like. The game chip 71 may store only the unique number, and the information other than the unique number may be stored in relation to the unique number in a server in the casino to retrieve the information based on the unique number read from the wireless IC tag 72.

The landed number detection device 52 is configured by an ID readout device (not shown in detail). The ID readout device is configured by orthogonally arranging an X-side transmitting antenna and an X-side receiving antenna extending in parallel with each other from an X-side scan driver, and a Y-side transmitting antenna and a Y-side receiving antenna extending in parallel with each other from a Y-side scan driver. In such an ID readout device, when a scan wave is transmitted from the X-side transmitting antenna and the Y-side transmitting antenna, a reading wave is generated in the vicinity of the cross point of the antennas. The reading wave is received by the X-side receiving antenna and the Y-side receiving antenna. When the roulette ball 61 exists in the vicinity of the cross point, the change in an impedance due to the roulette ball 61 becoming dielectric induces the change in the receiving status. The detection of the change in the status results in the determination of the existence of the roulette ball 61.

More specifically explained, the roulette wheel 51 is of a circular rotation body structure, and 38 pockets 54 in total (only a part thereof is shown in the figure) are formed concentrically to a central axis 53 thereof. In each pocket 54, the number (such as 0, 00, 1, 2, . . . , 35, 36) is shown which corresponds to a plurality of betting regions 3 assigned to the betting board 4. Each of the cross points of the ID readout device is located in 38 pockets 54. When entering into the pockets 54, the roulette ball 61 is positioned on any one of the cross points. The reading wave described above is generated all the time during the game, so that the roulette ball 61 positioned at a certain cross point causes the change in the receiving status of only that pocket 54. As a result, it is possible to detect into what position on the roulette wheel 51 (into what pocket 54) the roulette ball 61 enters. The data detected here is transmitted to a PTS (player tracking system) server (not shown) in the casino-hotel, in which the history thereof is collectively managed.

The roulette ball 61 is provided with a wireless IC tag (not shown) which stores roulette ball identification information for identifying the roulette ball 61. The wireless IC tag is embedded in the roulette ball 61, and the roulette ball identification information contains pieces of information about the place from where the roulette ball 61 is fed, the place where the roulette ball 61 can be used (the casino where the roulette ball 61 can be used), the type of the ball, etc. The roulette ball identification information stored in a roulette ball identification information storing means can be read out by the ID readout device of the landed number detection device 52. It is possible to determine whether the roulette ball 61 is available or not based on the read information. This can thus prevent the occurrence of frauds and infringements such as counterfeit of the roulette ball 61 to be brought in and used.

In such a game system, a person who wishes to play with the roulette wheel 51 brings a certification card to enter into the casino. The certification card is the one issued by a card issuing machine at a front desk of the hotel to a customer who checked in the casino-hotel in order to determine the customer. After the issuance, the customer presents the certification card to go through the check, and can thus use all the facilities in the casino-hotel. For example, at the checkout counter in a restaurant or bar in the hotel, a card reader reads the certification card to accumulate the amount of payment request in the server in the casino-hotel in association with the identification information about the customer. When the customer checks out the casino-hotel, the entire amount of payment request is displayed on a terminal at the front desk of the hotel. Thus, the certification card serves as a credit card for use in a variety of payments in the casino-hotel.

When bringing the certification card and entering into the casino, the customer obtains a desired number of game chips 71 from a game chip issuing/reimbursing machine, and then sets the certification card on a readout device (not shown) for reading the certification card that is provided on the betting board 4. The readout device reads the contents of the certification card to determine the customer who is thus recognized as a participant of the game. The data recognized by the readout device is transmitted to the aforementioned PTS server to be registered as that of the participant of the ongoing game. In addition, the readout system of the certification card (a magnetic readout system, an optical readout system) can be arbitrarily set in accordance with the recording mode of the certification card (a magnetic recording, an optical recording).

In the roulette game, a dealer initially rotates the roulette wheel 51, and then throws the roulette ball 61 into the roulette wheel 51. During this period, the participants of the game bet their game chips 71 in the desired betting regions 3 on the betting board 4. In the example of FIG. 2, a participant makes a bet on the corner (4, 5, 7, and 8), another participant makes a bet on the straight (9), and still another participant makes a bet on the column (2 to 1). The bet information detection device 11 detects the bet position and the value of the bet money (the amount of bet money such as $1, $5, $10) for each participant. The detected result is then transmitted to the PTS server in which the history thereof is collectively managed.

After that, the rotation of the roulette wheel 51 becomes slower. When the roulettes ball 61 lands in the pocket 54 indicating, for example, "8", the landed number detection device 52 detects the landed position "8". The detected result is then transmitted to the PTS server, where the history thereof is collectively managed. In addition, the PTS server may collectively manage histories and various data of a roulette wheel other than the roulette wheel 51, as well as the other game machines such as a slot machine.

In an aggregate analysis server (not shown) in the casino-hotel, a dividend calculation system is configured and calculates the dividend of the game (a roulette game) based on the position of the roulette ball 61 on the roulette wheel 51 (the landed number "8" in the above-mentioned example), and the bet position and value of the bet money of the game chip 71.

Figure 4:
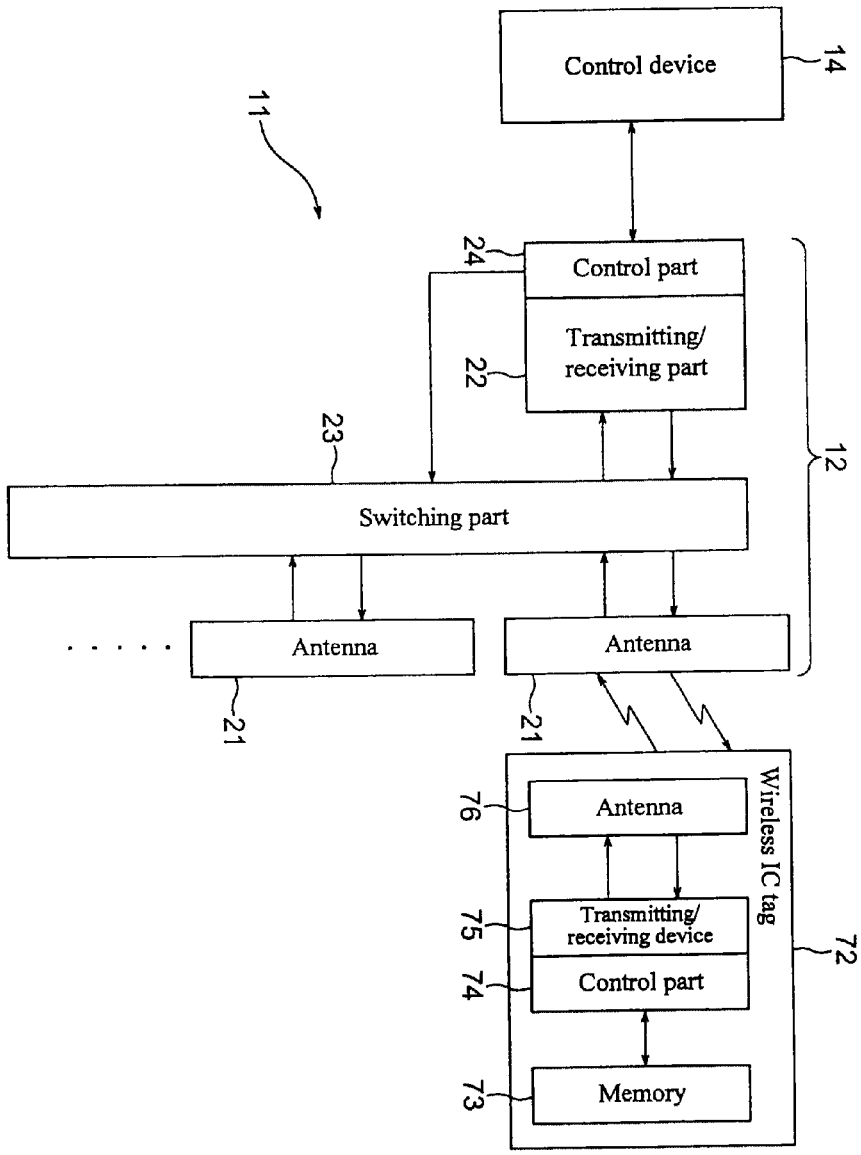
FIG. 4 is a block diagram showing an electrical connection among a readout device of a bet information detection device, a control device and a wireless IC tag of the game betting device according to an embodiment of the present invention.

FIG. 4 is a block diagram showing an electrical connection among a readout device 12 of the bet information detection device 11 of the game betting device1, the control device 14 and the wireless IC tag 72.

The control device 14 sends an instruction to the readout device 12 to generate a magnetic field from the antenna 21 so as to produce power at the wireless IC tag 72. The control device 14 also sends an instruction to the readout device 12 to read the information stored in the wireless IC tag 72 so as to transmit the data.

The readout device 12 is provided with a plurality of antennas (loop antennas) 21, a transmitting/receiving part 22, a switching part 23, and a control part 24.

The control part 24 receives an instruction from the control device 14, and controls the transmitting/receiving part 22 and the switching part 23 in response to the instruction.

The transmitting/receiving part 22 supplies power to the antenna 21 to generate a magnetic field (an electromagnetic field) so as to produce power at the wireless IC tag 72. Each of a plurality of antennas 21 is successively switched by the switching part 23 to receive the supplied power, and thus the magnetic fields are generated from the antennas 21 in a predetermined order. Along with the generation of the magnetic fields, the switching part 23 demodulates a load-modulated radio wave signal at the transmitting/receiving part 22, thereby the control device 14 reads out the information in the wireless IC tag 72.

The wireless IC tag 72 is what is called a magnetic field type wireless IC tag. The wireless IC tag 72 is provided with a memory 73, a control part 74, a transmitting/receiving part 75, and an antenna 76. The memory 73 is a storage device that stores a unique number for determining the game chip 71 (the number for identifying the game chip 71). As described above, the memory 73 may also store the pieces of information about the value (such as $1, $5, $10) and color of the game chip 71, a place where the game chip 71 can be used (the information for identifying the casino where the game chip 71 is used), and the like. The control part 74 interprets a command, a request, an instruction, etc., received from the readout device 12, and implements the operations in response thereto. The transmitting/receiving part 75 has a modulation part (not shown) and a demodulation part (not shown) to modulate/demodulate a signal for establishing communication with the readout device 12. The antenna 76 supplies power to the transmitting/receiving part 75 by the magnetic field from the readout device 12, and also receives the modulated signal from the transmitting/receiving part 75 to emit the modulated radio wave in the air so as to be received by the readout device 12.

Although the bet information detection device 11 employs the antenna 21 of the readout device 12 for both producing power at the wireless IC tag 72 and reading the information in the wireless IC tag 72, as described above, these operations may be implemented by use of separate antennas.

Next, the arrangement of the antennas 21 and the driving thereof will be described.

Figure 5:
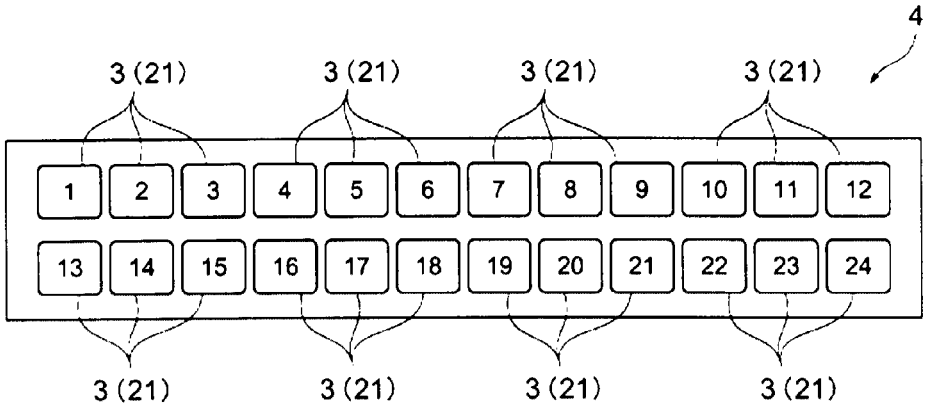
FIG. 5 is an explanatory drawing showing an actual arrangement of betting regions and antennas on the betting board according to an embodiment of the present invention.

FIG. 5 is an explanatory drawing showing a specific arrangement of the betting regions 3 and the antennas 21 on the betting board 4.

The betting board 4 shown in FIG. 5 is not the one that is actually used as shown in FIG. 2, but the one for convenience in explaining. The betting board 4 is provided with 12 columns and two rows, namely 24 betting regions 3 in total. The antennas 21 are provided individually corresponding to each of 24 betting regions 3. Thus, each of 24 betting regions 3 has its own antenna corresponding thereto. In FIG. 5, the numbers 1 to 24 are assigned to each of the antenna 21 located in each of 24 betting regions 3.

Figure 6:
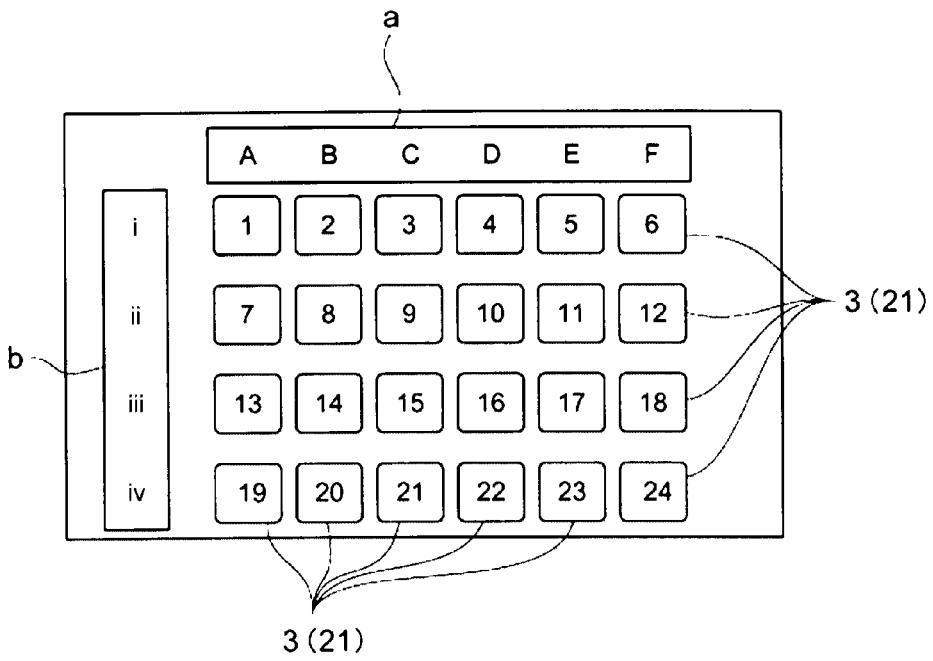
FIG. 6 is an explanatory drawing showing a logical arrangement of betting regions and antennas on the betting board according to an embodiment of the present invention.

FIG. 6 is an explanatory drawing showing a logical arrangement of the betting regions 3 and the antennas 21 on the betting board 4.

24 Antennas 21 are divided into and assigned to groups. First, all 24 antennas 21 belong to a plurality of major groups, e.g., both two major groups (a) and (b) in the example shown in FIG. 6. Thus, all the antennas 21 of Nos. 1 to 24 belong to the major group (a), and also belong to the major group (b).

The major groups (a) and (b) are respectively divided into smaller groups. The major groups (a) and (b) differ from each other in classification of the small groups.

First, the major group (a) is classified into small groups (A) to (F). In other words, the major group (a) has the small groups (A) to (F). The small group (A) includes the antennas 21 of Nos. 1, 7, 13 and 19; the small group (B) includes the antennas 21 of Nos. 2, 8, 14 and 20; the small group (C) includes the antennas 21 of Nos. 3, 9, 15 and 21; the small group (D) includes the antennas 21 of Nos. 4, 10, 16 and 22; the small group (E) includes the antennas 21 of Nos. 5, 11, 17 and 23; and the small group (F) includes the antennas 21 of Nos. 6, 12, 18 and 24.

At the same time, the major group (b) is classified into small groups (i) to (iv). In other words, the major group (b) has the small group (i) to (iv). The small group (i) includes the antennas 21 of Nos. 1 to 6; the small group (ii) includes the antennas 21 of Nos. 7 to 12; the small group (iii) includes the antennas of Nos. 13 to 18; and the small group (iv) includes the antennas of Nos. 19 to 24.

24 Antennas 21 are divided into the small groups so that one antenna 21 with the same number assigned can belong to both any one of the small groups of the major group (a) and any one of small groups of the major group (b), but two or more antennas 21 with the same number assigned can belong to neither small groups of the major group (a) nor small groups of the major group (b).

All of the 24 antennas 21 are assigned to the small groups (A) to (F) included in the major group (a). Each of 24 antennas 21 belongs to any one of the small groups (A) to (F). All of 24 antennas 21 are assigned to the small groups (i) to (iv) included in the major group (b). Each of 24 antennas 21 belongs to any one of the small groups (i) to (iv). The 24 antennas 21 belonging to the small groups (A) to (F) are assigned to the small groups (i) to (iv) so that each of 24 antennas 21 belonging to each of the small groups (A) to (F) belongs to the small groups (i) to (iv) different from each other. The 24 antennas 21 belonging to the small groups (i) to (iv) are assigned to the small groups (A) to (F) so that each of 24 antennas 21 belonging to each of the small groups (i) to (iv) belongs to the small groups (A) to (F) different from each other.

At least one column or at least one row shown in FIG. 5 includes more than one small groups included in a single major group. More specifically, the top row out of the rows shown in FIG. 5 includes the antennas 21 of Nos. 1 to 6 belonging to the small group (i) and Nos. 7 to 12 belonging to the small group (ii). The small group (i) and the small group (ii) are included in the the major group (b) as shown in FIG. 6. Likewise, the second row out of the rows shown in FIG. 5 includes the antennas 21 of Nos. 13 to 18 belonging to the small group (iii) and Nos. 19 to 24 belonging to the small group (iv). The small group (iii) and the small group (iv) are included in the major group (b) as shown in FIG. 6.

Figure 7:
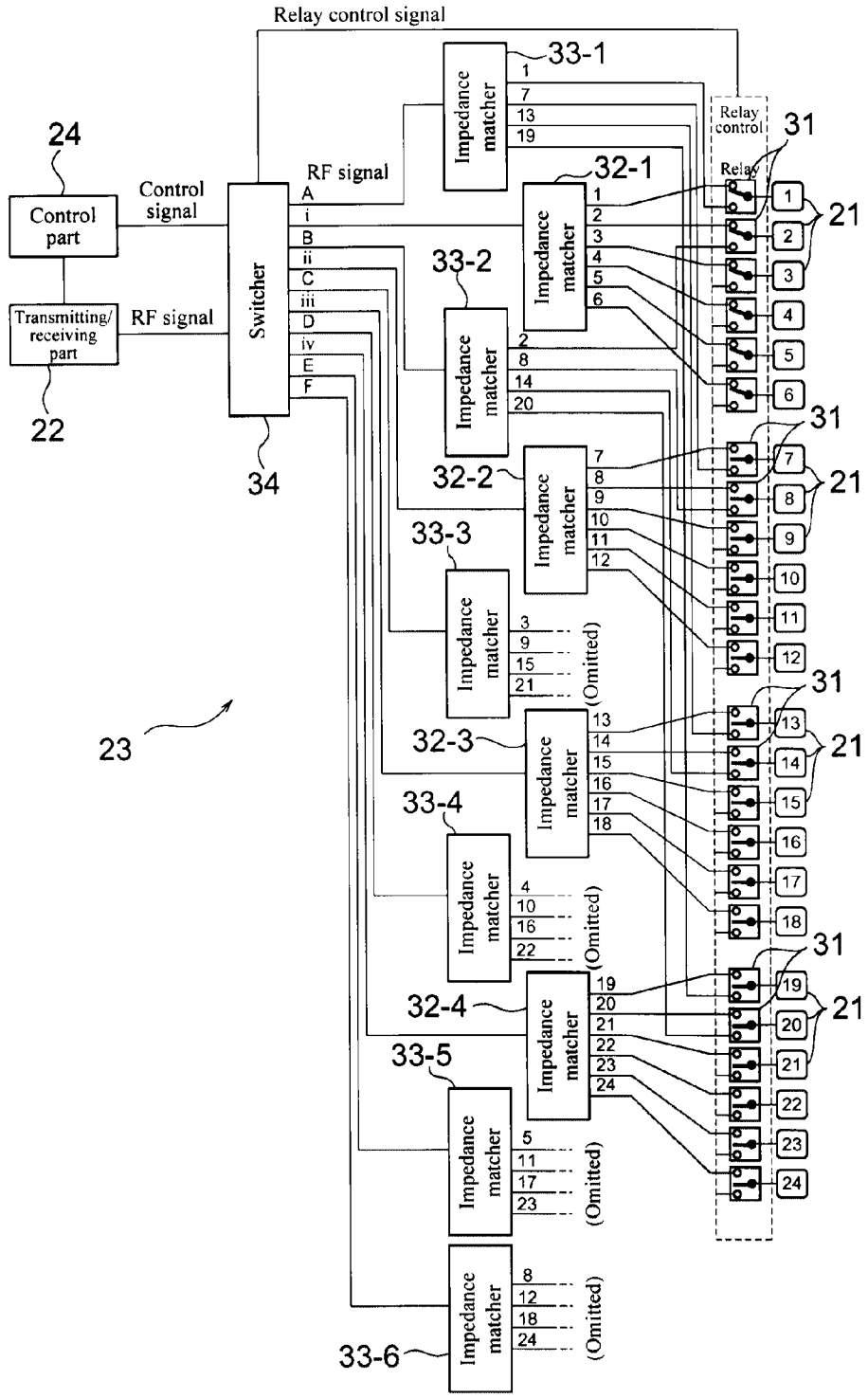
FIG. 7 is a diagram showing a circuit configuration of a switching part of the readout device according to an embodiment of the present invention.

FIG. 7 is a diagram showing a circuit configuration of the switching part 23 of the readout device 12.

The switching part 23 is provided with a plurality of relays 31 arranged for each antenna 21, impedance matchers 32 (32-1 to 32-4) and 33 (33-1 to 32-6) each connected to a plurality of relays 31, and a switcher 34.

The impedance matchers 32-1 to 32-4 are respectively connected to the relays 31 for switching the antennas 21 belonging to the small groups (i) to (iv). The impedance matchers 33-1 to 33-6 are respectively connected to the relays 31 for switching the antennas 21 belonging to the small groups (A) to (F) (the wiring from the impedance matchers 33-3 to 32-6 to the relays 31 is omitted for reasons of expediency). The impedance matchers 32 and 33 implement the impedance matching between the transmitting/receiving part 22 and the antennas 21.

Figure 8A:
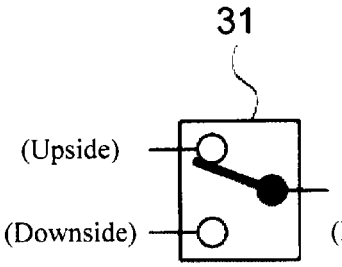
FIG. 8A is an explanatory drawing showing a switching of a relay according to an embodiment of the present invention.
Figure 8B:
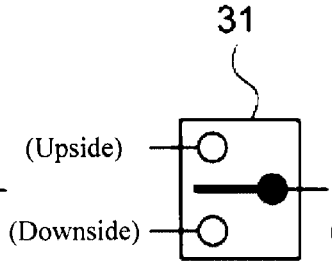
FIG. 8B is an explanatory drawing showing a switching of a relay according to an embodiment of the present invention.
Figure 8C:
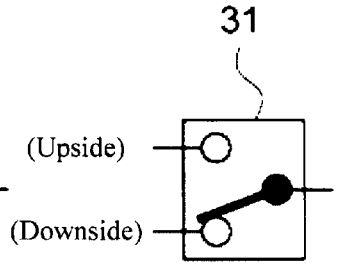
FIG. 8C is an explanatory drawing showing a switching of a relay according to an embodiment of the present invention.

FIGS. 8A, 8B, and 8C are explanatory views showing the switching of the relay 31.

When flipped up as shown in FIG. 8A, the relays 31 connect the antennas 21 belonging to the small groups (i) to (iv) to the corresponding impedance matchers 32-1 to 32-4. When flipped down as shown in FIG. 8C, the relays 31 connect the antennas 21 belonging to the small groups (A) to (F) to the corresponding impedance matchers 33-1 to 33-6. When flipped neither up nor down as shown in FIG. 8B, the antennas 21 are not connected to the impedance matchers 32-1 to 32-4, or 33-1 to 32-6.

A relay control signal is sent from the control part 24 via the switcher 34 to the desired relay 31 to switch a plurality of relays 31. The readout signal (an RF signal) sent from the transmitting/receiving part 22 is supplied via the switcher 34 to a desired impedance matcher 32 or 33.

For example, in the case of driving the antennas 21 belonging to the small group (i), all the relays 31 that switch all the antennas 21 belonging to the small group (i) are flipped up, and the other relays 31 are flipped neither up nor down. Then, the RF signal is sent only to the impedance matcher 32-1. Consequently, all the antennas 21 belonging to the small group (i) are simultaneously driven, so that the game chips 71 are simultaneously read out in all the betting regions 3 corresponding to all the antennas 21 belonging to the small group (i). As discussed above, the antennas 21 are driven simultaneously to all the antennas 21 belonging to the small group.

Figure 9:
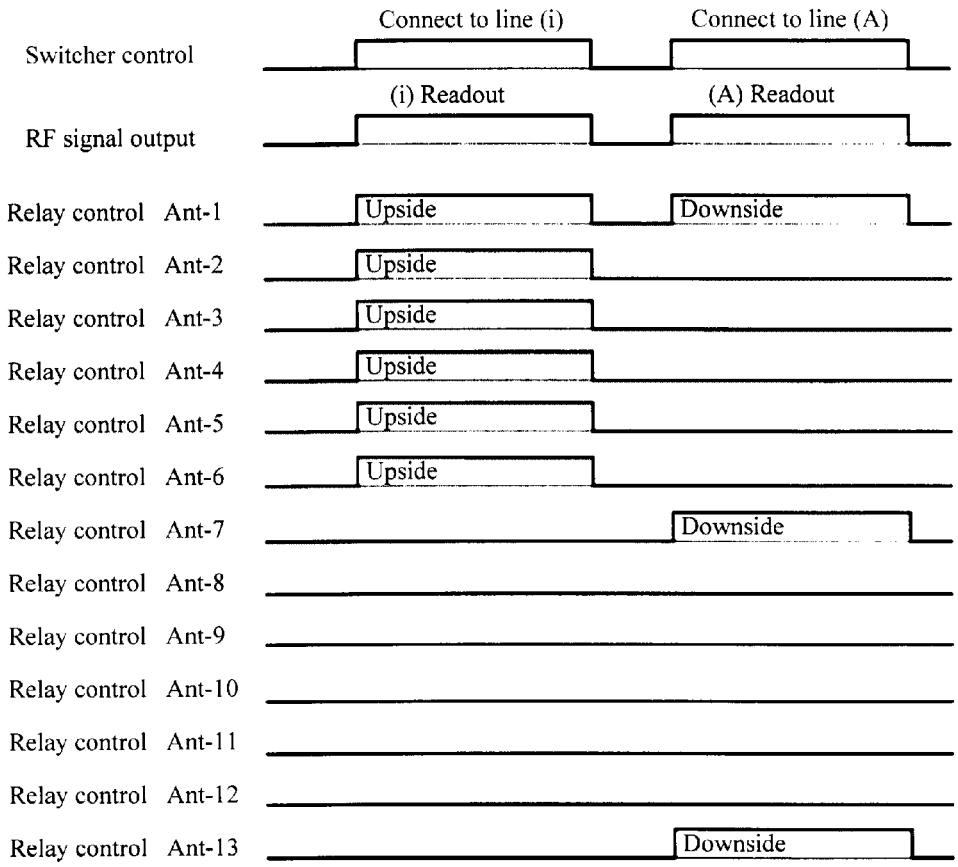
FIG. 9 is a timing chart showing the operation of the switching part according to an embodiment of the present invention.

FIG. 9 is a timing chart showing the operation of the switching part 23.

In this figure, a signal of "switcher control" is a switching signal for selecting the impedance matcher that sends the RF signal. A signal of "RF signal output" indicates the output signal of the RF signal. "Ant-1" and "Ant-2", . . . , of "relay control" indicate the status of the relay 31 of the first antenna 21, the relay 31 of the second antenna 21, . . . (the 14th antenna 21 and below are not shown), and also show the connection status or non-connection status of the corresponding relays 31.

In FIG. 9, for example, when the small group (i) is to be selected, the impedance matcher 32-1 is selected by the "switcher control" to send the RF signal. The relays 31 corresponding to the antennas 21 of Nos. 1 to 6 corresponding to the small group (i) are then flipped up so as to connect the impedance matcher 32-1 to the antennas 21 of Nos. 1 to 6.

Likewise, when the small group (A) is to be selected, the impedance matcher 33-1 is selected by the "switcher control" to send the RF signal. The relays 31 corresponding to the antennas 21 of Nos. 1, 7, 13 and 19 corresponding to the small group (A) are then flipped down so as to connect the impedance matcher 33-1 to the antennas 21 of Nos. 1, 7, 13 and 19.

In this manner, the operation to simultaneously drive all the antennas 21 belonging to an identical small group is implemented to all the small groups successively for each small group. The reading out is thus carried out for the game chips 71 located on all the betting regions 3. Then, the execution of the logical AND operation between the readout result of each of the small groups included in the major group (a) and the readout result of each of the small groups included in the major group (b) makes it possible to determine on what betting region 3 what game chip 71 exists. For example, when the execution of the logical AND operation between the small group (A) and the small group (i) results in the readout of a certain identification number for identifying a certain game chip 71 in both the small group (A) and the small group (i), this indicates that it is the antenna 21 of No. 1 that belongs both the small group (A) and the small group (i). It is thus possible to determine that the game chip 71 having the identification number exists on the betting region 3 corresponding to the antenna 21 of No. 1.

In the examples shown in FIGS. 5 and 6, there are ten small groups (A) to (F) and (i) to (iv) in total, and thus merely ten times of readout operation is required. On the other hand, the number of antennas 21 is 24. If the readout operation is carried out successively for each antenna 21, 24 times of readout operation must be implemented. In this manner, since this embodiment requires only ten times of readout operation, it is possible to reduce the number of switching of the antenna 21, thereby enhancing the speed of the readout operation of the game chip 71 on the betting board 4. It is the switching operation of the antenna 21 that takes time in the readout operation, and thus the reduction in the number of switching of the antenna 21 makes it possible to enhance the speed of the entire readout operation.

Figure 10:
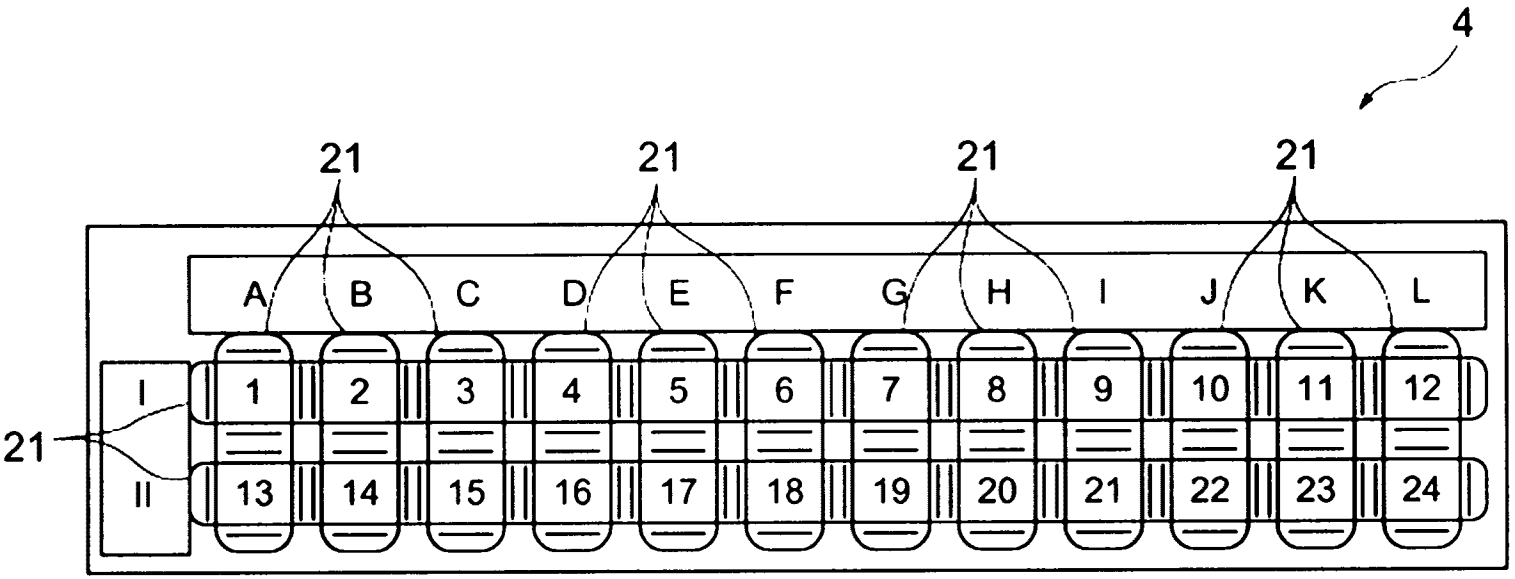
FIG. 10 is an explanatory diagram of the game betting device as a comparative example to an embodiment of the present invention.

FIG. 10 is an explanatory diagram of a game betting device 100 as a comparative example.

The game betting device 100 is provided with 14 antennas 121 having the formation of lining along the matrix of betting regions 103 for each line of matrix of the betting regions 103. More specifically, the device 100 is provided with the antennas 121 that correspond to all the betting regions 103 included in 12 columns A to L, and the antennas 121 that correspond to all the betting region 103 included in two rows (I) and (II), respectively. Then, each of the 14 antennas 121 separately implements the readout operation successively so as to store the readout result. Then, the logical AND operation is implemented between the readout result of 12 columns A to L and the readout result of two rows (I) and (II), and from the result thereof it is possible to determine whether or not there is the game chip 71 on each of the betting regions 103. In this comparative example, there are 14 antennas 121, and thus the readout operation is executed for 14 times. It can be found that the case of the aforementioned embodiments shown in FIGS. 5 and 6 requires smaller number of switching of the antenna 21, thereby enabling the speed of the readout operation to be enhanced.

The aforementioned embodiments shown in FIGS. 5 and 6 have included two major groups (a) and (b), and the logical arrangement of the antennas 21 (the betting regions 3) was a 6×4 two-dimensional matrix (refer to FIG. 6). The present invention is not limited to this, but the logical arrangement of the antennas 21 (the betting regions 3) may be a three-dimensional matrix or more.

Next, the example will be explained in which the logical arrangement of the antennas 21 (the betting regions 3) is a three-dimensional matrix.

Figure 11:
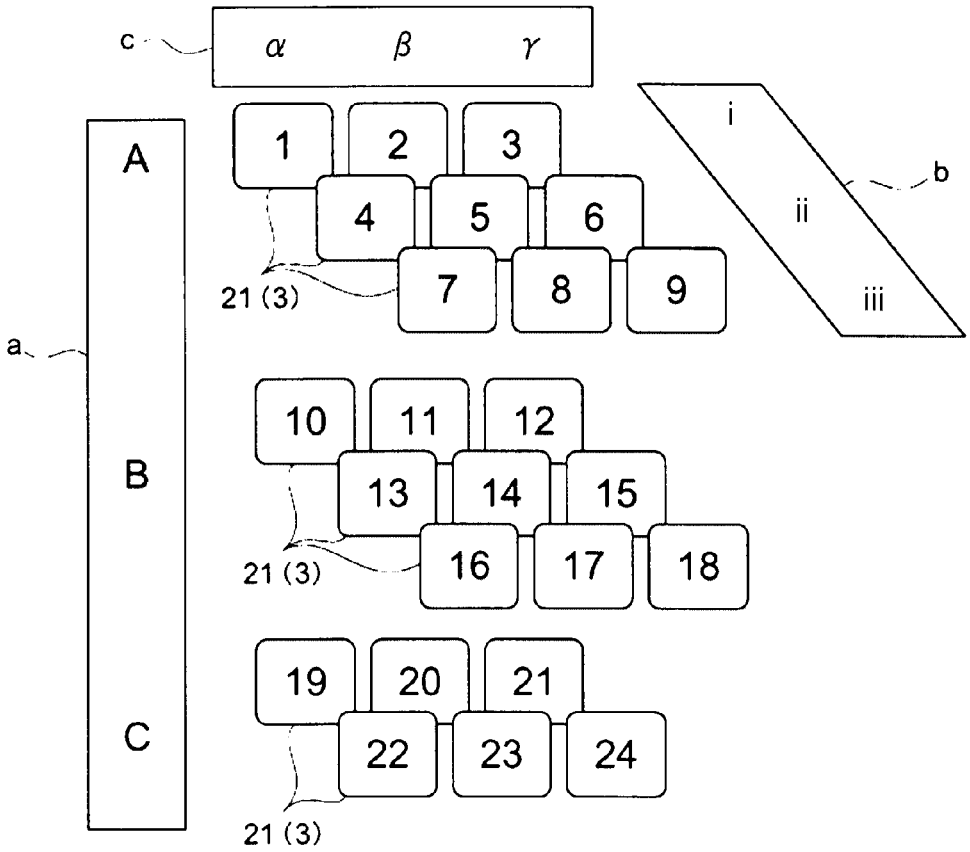
FIG. 11 is an explanatory diagram for explaining an example in which the logical arrangement of the antennas (the betting regions) constitutes the three-dimensional matrix, according to an embodiment of the present invention.

FIG. 11 is an explanatory diagram for explaining an example in which the logical arrangement of the antennas 21 (the betting regions 3) is the three-dimensional matrix.

There are three major groups (a), (b) and (c). The major group (a) is classified into small groups (A) to (C); the major group (b) is classified into small groups (i) to (iii); and the major group (c) is classified into small groups (α) to (γ).

The small group (A) includes the antennas 21 of Nos. 1 to 9; the small group (B) includes the antennas 21 of Nos. 10 to 18; and the small group (C) includes the antennas 21 of Nos. 19 to 24.

The small group (i) includes the antenna 21 of Nos. 1 to 3, 10 to 12 and 19 to 21; the small group (ii) includes the antenna 21 of Nos. 4 to 6, 13 to 15 and 22 to 24; and the small group (iii) includes the antenna 21 of Nos. 7 to 9 and 16 to 18.

The small group (a) includes the antenna 21 of Nos. 1, 4, 7, 10, 13, 16, 19 and 22; the small group (β) includes the antenna 21 of Nos. 2, 5, 8, 11, 14, 17, 20 and 23; and the small group (γ) includes the antenna 21 of Nos. 3, 6, 9, 12, 15, 18, 21 and 24.

In the example shown in FIG. 11, there are nine small groups, i.e., (A) to (C), (i) to (iii) and (α) to (γ). Thus, it can be found that the number of switching of the readout operation by the antennas 21 is sufficiently reduced to nine times so that it is possible to enhance the speed of the readout operation of the game chip 71.

The description will be made below regarding to what extent the speed of the readout operation can be enhanced, referring to the specific examples (Examples 1 and 2).

The example of the game betting device 201 is herein described. In the device 201, 27 betting regions 3 in total are physically aligned with nine columns and three rows. In each of 27 betting regions 3 of the game betting device 201, a single antenna 21 is individually located. The example shows the case where the length of time required to switch the antenna 21 is 0.5 second and the length of time required to read a single game chip 71 is 0.05 second.

FIG. 12 shows the readout units in Examples 1 and 2.

Example 1 is the case where the logical arrangement of 27 antennas 21 (the betting regions 3) is two-dimensionally structured to be a 9×3 logical matrix. More specifically, this is the example in which there are two major groups (a) and (b), and 27 antennas 21 are arranged so that the major group (a) includes nine small groups and the major group (b) includes three small groups. In this case, there are 12 antennas 21 in total, so that the readout unit, i.e., the number of times that readout operation is implemented, is 12. Likewise, Example 2 is the case where the logical arrangement of 27 antennas 21 (the betting regions 3) is three-dimensionally structured to be a 3×3×3 logical matrix. More specifically, this is the example in which there are three major groups (a), (b) and (c), and 27 antennas 21 are arranged so that the major group (a) includes three small groups, the major group (b) includes three small groups and the major group (c) includes three small groups. In this case, there are nine antennas in total, so that the readout unit is nine.

FIG. 13 shows the amounts of readout time in Examples 1 and 2.

"Standard" is the example of the case where the readout operation is executed individually for each of 27 antennas 21 regarding the betting regions 3, as is conventionally done. "Readout time when the number of game chips is as follows" indicates the time required only to read out the game chip 71 when the indicated number of game chip or chips 71 is/are read out. "Total amount of time of antenna switching and readout time" indicates the sum total of "the readout time when the number of game chips is as follows" and the time required to switch the antenna 21.

Figure 14:
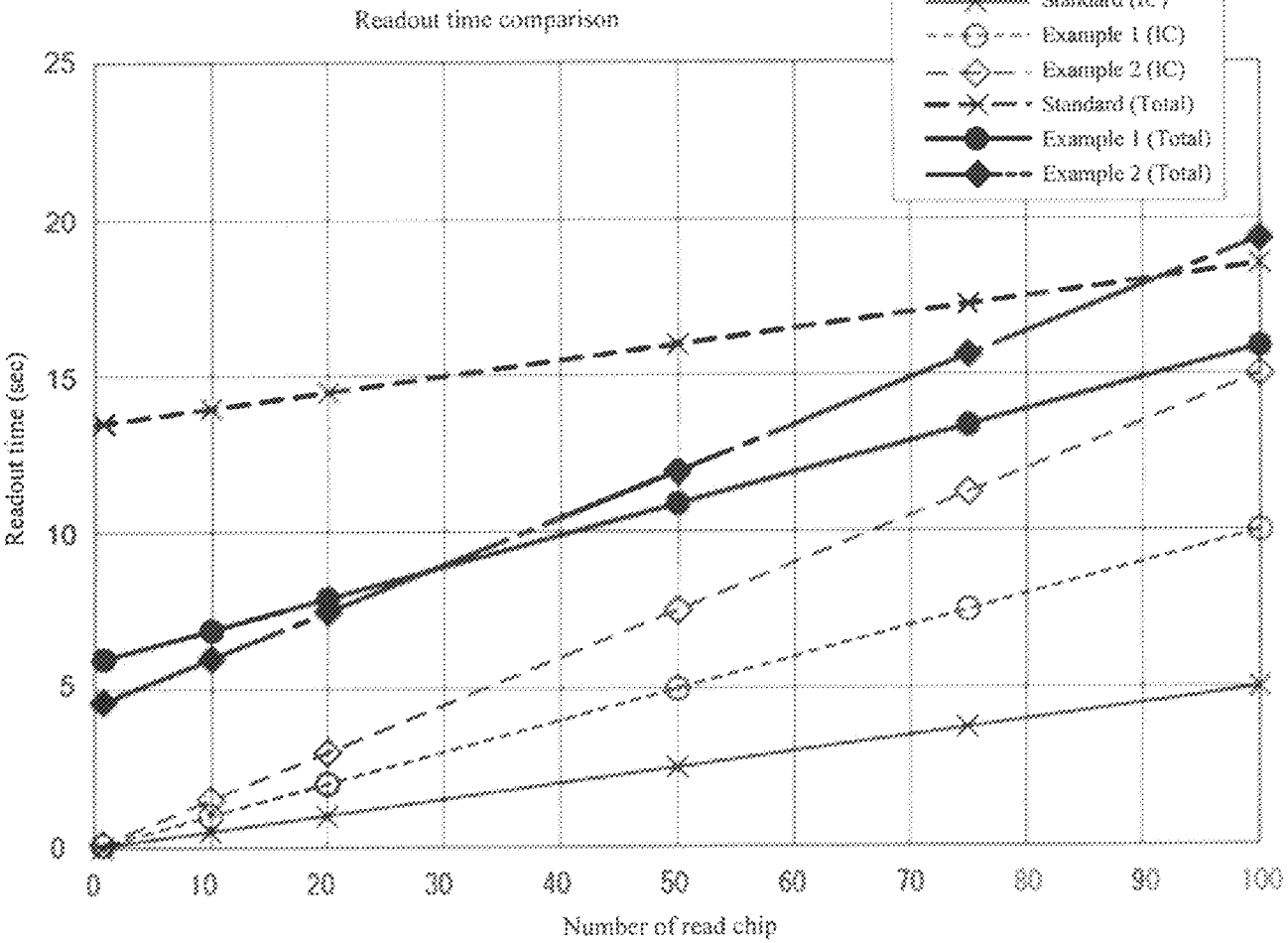
FIG. 14 is an explanatory diagram showing a specific example according to an embodiment of the present invention.

FIG. 14 is a graph of the result of FIG. 13.

This is the graph with the number of read game chip 71 on the horizontal axis and the readout time of the game chip 71 on the vertical axis. (IC) indicates the readout time required only to read out the game chip 71, and (Total) indicates the total readout time: the total sum of the readout time required only to read out the game chip 71 and the time required to switch the antenna 21.

As is evident from FIG. 14, although it depends on the number of the read game chip 71, it can be found that "Example 1" and "Example 2" can reduce the readout time in general, compared to "Standard".

Moreover, in order to reduce the readout time, it is efficient that the same or approximately the same number of small groups belongs to the major groups different to each other.

What is claimed is:

1. A game betting device, comprising:

a betting board provided with a plurality of betting regions;

a group of antennas having a plurality of antennas which correspond to said plurality of betting regions defined by a plurality of rows and a plurality of columns, respectively, each of said plurality of antennas belonging to any of a plurality of major groups, each of said major groups being further classified into a plurality of small groups, each of said major groups having the classification of said plurality of small groups different from each other, at least one column or at least one row in the alignment of said plurality of betting regions including said antennas belonging to said small groups different from each other in an identical major group, wherein the plurality of major groups include a first major group and a second major group, the plurality of small groups of the first major group correspond to the plurality of rows, respectively, the plurality of small groups of the second major group correspond to the plurality of columns, respectively;

a detection device which successively drives said plurality of small groups in each of said major groups and simultaneously drives all antennas in a column or a row as a small group for each of said small groups to detect a game chip on said betting board; and a determination device which implements a logical AND operation between said major groups regarding the detected result of said chip to determine said betting region having said chip put thereon.

2. A game betting device, comprising:

a plurality of antennas capable of communicating with a game chip, each antenna being provided corresponding to each of a plurality of betting regions defined by a plurality of rows and a plurality of columns, said plurality of antennas being divided into a plurality of first groups and a plurality of second groups, all of said antennas being assigned to said plurality of first groups, each of said plurality of antennas belonging to any one of said plurality of first groups, all of said antennas being assigned to the plurality of second groups, each of said plurality of antennas belonging to any one of the plurality of second groups, the antennas belonging to said plurality of first groups being assigned to said plurality of second groups so that the antennas belonging to each of said first groups belong to said plurality of second groups different from each other, respectively, wherein the plurality of first groups correspond to the plurality of rows, respectively, and the plurality of second groups correspond to the plurality of columns, respectively;

a control device which successively sends a first selection signal for selecting each of said plurality of first groups and a second selection signal for selecting each of said plurality of second groups;

an antenna selecting device which successively selects each of said plurality of first groups in response to said first selection signal to transmit to said control device a first output signal sent from the antenna belonging to the selected first group, all antennas in a row as the selected first group being simultaneously driven in response to said first selection signal, and which successively selects each of said plurality of second groups in response to said second selection signal to transmit to said control device a second output signal sent from the antenna belonging to the selected second group, all antennas in a column as the selected second group being simultaneously driven in response to said second selection signal; and a chip determination device which determines the betting region having the game chip put thereon out of said plurality of betting regions from a result of a logical AND operation between the first chip readout result indicated by said first output signal and the second chip readout result indicated by said second output signal.

3. The game betting device according to claim 2, wherein, when one group is selected by said first selection signal from among the first groups, signals simultaneously sent from the antennas belonging to the selected first group are transmitted as said first output signal to said control device and, when one group is selected by said second selection signal from among the second groups, signals simultaneously sent from the antennas belonging to the selected second group are transmitted as said second output signal to said control device.

4. The game betting device according to claim 3, wherein said first chip readout result and said second chip readout result are identification numbers for identifying the game chips.

5. The game betting device according to claim 4, wherein each of said plurality of antennas has approximately the same size.

6. The game betting device according to claim 2, wherein the antenna selecting device includes a plurality of relays which connected to said plurality of antennas, respectively, wherein each of said plurality of relays transmits the first output signal from a corresponding antenna to said control device in response to said first selection signal, and each of said plurality of relays transmits the second output signal from the corresponding antenna to said control device in response to said first selection signal.

7. The game betting device according to claim 6, wherein the antenna selecting device further includes a plurality of first impedance matchers which correspond to said plurality of first groups, respectively, and a plurality of second impedance matchers which correspond to said plurality of second groups, respectively, wherein each of said plurality of first impedance matchers is connected to the relays for the antennas belonging to a corresponding first group and is configured to implement impedance matching for the antennas belonging to the corresponding first group in response to the first selection signal, and wherein each of said plurality of second impedance matchers is connected to the relays for the antennas belonging to a corresponding second group and is configured to implement impedance matching for the antennas belonging to the corresponding second group in response to the second selection signal.

8. The game betting device according to claim 1, wherein the detection device comprises:

a control device which successively sends selection signals for selecting each of said plurality of small groups in said major groups; and an antenna selecting device which successively selects each of said plurality of small groups in said major groups in response to said selection signals to transmit to said control device output signals sent from the antennas belonging to the selected small group, wherein the determination device which implements the logical AND operation based on the output signals.

9. The game betting device according to claim 8, wherein said selection signals include a first selection signal and a second selection signal, the antenna selecting device includes a plurality of relays which connected to said plurality of antennas, respectively, each of said plurality of relays transmits the output signal from a corresponding antenna to said control device in response to the first selection signal, and each of said plurality of relays transmits the output signal from the corresponding antenna to said control device in response to the second selection signal.

10. The game betting device according to claim 9, wherein the antenna selecting device further includes a plurality of first impedance matchers corresponding to said first major group, and a plurality of second impedance matchers corresponding to said second major group, wherein each of said plurality of first impedance matchers is connected to the relays for the antennas belonging to a corresponding one of said plurality of small groups in the first major group and is configured to implement impedance matching for the antennas belonging to the corresponding small group in response to the first selection signal, and wherein each of said plurality of second impedance matchers is connected to the relays for the antennas belonging to a corresponding one of said plurality of small groups in the second major group and is configured to implement impedance matching for the antennas belonging to the corresponding small group in response to the second selection signal.

* * * * *